US008597140B2

(12) United States Patent
Komatsu et al.

(10) Patent No.: US 8,597,140 B2
(45) Date of Patent: Dec. 3, 2013

(54) MULTI-PIECE SOLID GOLF BALL

(75) Inventors: Atsushi Komatsu, Chichibu (JP); Atsushi Nanba, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 636 days.

(21) Appl. No.: 12/629,221

(22) Filed: Dec. 2, 2009

(65) Prior Publication Data

US 2011/0130219 A1 Jun. 2, 2011

(51) Int. Cl.
*A63B 37/06* (2006.01)

(52) U.S. Cl.
USPC ..... 473/373

(58) Field of Classification Search
USPC ..... 473/376, 373, 374
See application file for complete search history.

(56) References Cited

U.S. PATENT DOCUMENTS 6,417,278 B1 * 7/2002 Ladd et al. ..... 525/193
2009/0011856 A1 * 1/2009 Ladd et al. ..... 473/372

FOREIGN PATENT DOCUMENTS

JP 07-155403 A 6/1995
JP 2000-051394 A 2/2000
JP 2000-350795 A 12/2000

* cited by examiner

*Primary Examiner* — Raeann Gorden
(74) *Attorney, Agent, or Firm* — Sughrue Mion, PLLC

(57) ABSTRACT

A multiple-piece solid core golf ball includes a solid core including an inner core layer and an outer core layer, and a cover disposed on the outside of the solid core. The inner core layer has an outer diameter of at most approximately 25 mm and is formed of a material having a loss tangent (tan δ) of at least approximately 0.1. The outer core layer is formed of a material having a loss tangent (tan δ) of from approximately 0.01 to approximately 0.1. The difference between the loss tangent (tan δ) of the material forming the inner core layer and the loss tangent (tan δ) of the material forming the outer core layer is at least approximately 0.05.

9 Claims, 1 Drawing Sheet

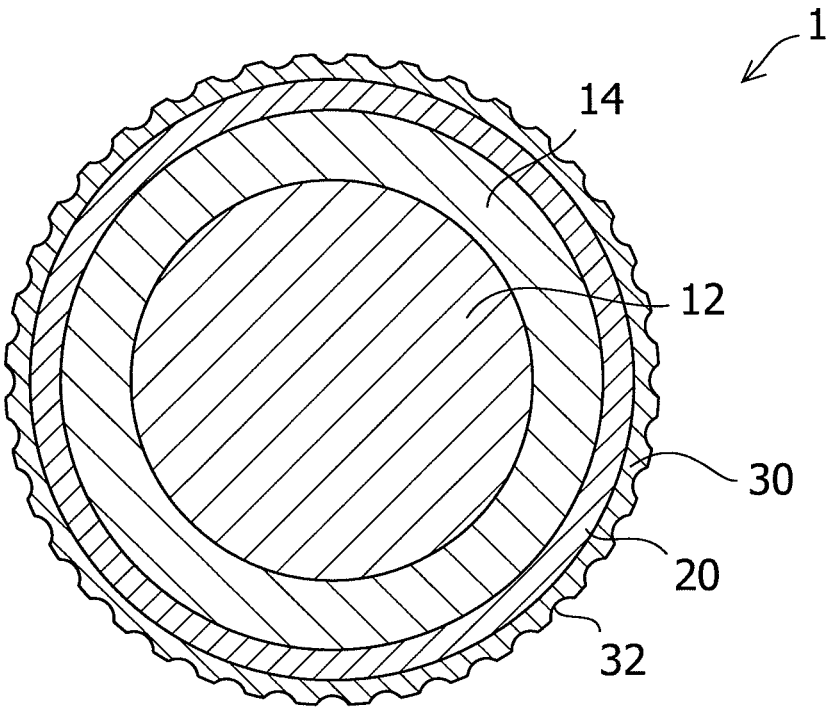
1
14
12
30
20
32

MULTI-PIECE SOLID GOLF BALL

BACKGROUND OF THE INVENTION

The present invention relates to a multiple-piece solid golf ball.

Although there are many factors that affect the carry of a golf ball, among these, the three factors of initial ball velocity, striking angle, and amount of spin are referred to as the three elements of ball carry, and are considered to be very important. Of these, the initial velocity of the ball is restricted by regulations.

Golf balls are developed in accordance with the above-noted regulations, many of them being developed for professional golfers and advanced amateurs with a high head speed, and when struck by a player having a low head speed, the initial velocity of the ball is much lower than the limited imposed by the regulations, and it is sometimes not possible to achieve a satisfactory carry.

In Japanese Patent Application Publication 2000-350795, in order to achieve an initial ball velocity that is close to the case in which the ball is struck at a relatively high head speed of approximately 50 m/s even if the golf ball is struck at a relatively low head speed of approximately 40 m/s, there is a description of a solid golf ball with a solid core with a multilayer construction that includes an innermost core and at least one layer covering the innermost core and a cover that covers the solid core, wherein the innermost core exhibits a rebound of less than 95 cm when free falling from a height of 120 cm, and also wherein the diameter of the above-noted innermost core is 18 mm or smaller.

Also, in Japanese Patent Application Publication 7-155403, there is a description, for the purpose of providing a golf ball having high repulsion performance, of the use as a material to form the solid core of the golf ball of a rubber composition using as the main component a diene rubber having a loss tangent (tan δ) of 0.01 or greater and 0.2 or lower. Also, in Japanese Patent Application Publication 2000-51394, for the purpose of providing a golf ball having a soft feel on impact but a small reduction in repulsion performance, there is a description of the use of a material having a JIS-A hardness of 70 or less and also a loss tangent (tan δ) of 0.03 or lower.

SUMMARY OF THE INVENTION

The present invention has as an object to provide a multiple-piece solid golf ball that, in the case in which it is struck at a very low head speed of approximately 10 m/s to approximately 30 m/s, achieves a repulsion coefficient that is higher than in the case in which a golf ball is struck at a high speed of, for example, approximately 50 m/s, enabling an improvement over the past in the initial ball velocity at a low head speed.

To achieve the above-noted object, according to the present invention, a multiple-piece solid golf ball includes a solid core including an inner core layer and an outer core layer, and a cover disposed on the outside of the solid core, wherein the inner core layer has an outer diameter of approximately 25 mm or smaller and is formed of a material having a loss tangent (tan δ) of approximately 0.1 or greater, wherein the outer core layer is formed of a material having a loss tangent (tan δ) of approximately 0.01 to approximately 0.1, and wherein the difference between the loss tangent (tan δ) of the material forming the inner core layer and the loss tangent (tan δ) of the material forming the outer core layer is approximately 0.05 or greater.

In this case, the loss tangent (tan δ) is indicated by the loss modulus of elasticity divided by the storage modulus of elasticity, and is also referred to as the dynamic viscoelasticity. This loss tangent (tan δ) can be measured using a commercially available measuring instrument, for example the DMA Q800 dynamic viscoelasticity meter manufactured by TA Instruments. As test conditions, the test sample is made to have dimensions of 3 mm (width)×1 mm (thickness)×20 mm (length) (this length being the actually measured length, and does not include the parts at both ends at which it is grabbed). The initial strain is 0.1 N, the amplitude is 1%, and the frequency is 15 Hz. Measurement is performed with a rate of temperature rise of 3° C./minute from −100° C. to 80° C., and the value is taken at −10° C.

The material used to form the inner core layer may be made to have a composition having 60 or more parts by weight of a low-repulsion rubber and 40 parts or less by weight of a high-repulsion rubber, and the material used to form the outer core layer may be made to have a composition having 60 or more parts by weight of high-repulsion rubber and 40 parts or less by weight of low-repulsion rubber.

The value obtained by adding the value of the volume of the inner core layer multiplied by the loss tangent (tan δ) of the material forming the inner core layer to the value of the volume of the outer core layer multiplied by the loss tangent (tan δ) of the material forming the outer core layer may be made to be equal to the value obtained by multiplying the sum of the volume of the inner core layer and the volume of the outer core layer by a value within the range from approximately 0.01 to approximately 0.10.

The thickness of the above-noted cover can be approximately 0.3 to approximately 1.5 mm. The hardness of the cover can be made a Shore D hardness of approximately 40 to approximately 55. The multiple-piece solid golf ball of the present invention may further include an intermediate layer disposed between the solid core and the cover. The intermediate layer can be formed of a material that includes a highly neutralized ionomer resin.

BRIEF DESCRIPTIONS OF THE DRAWINGS

FIG. 1 is a cross-sectional view showing an embodiment of a multiple-piece solid golf ball according to the present invention.

DESCRIPTION OF THE PREFERRED EMBODIMENTS

Although embodiments of a multiple-piece solid golf ball according to the present invention are described below, the present invention is not restricted to these embodiments.

As shown in FIG. 1, a multiple-piece solid golf ball 1 of this embodiment includes a solid core 12, 14 and a cover 30 positioned on the outside of the solid core. The solid core has an inner core layer 12 positioned centermost in the golf ball 1, and an outer core layer 14 that covers the inner core layer 12. Although an intermediate layer 20 may be provided between the solid core and the cover, as shown in FIG. 1, the present invention is not restricted in this regard, and it is possible to adopt a constitution in which an intermediate layer is not provided, the cover 30 being in direct contact with the solid core, that is, with the outer core layer 14.

The inner core layer 12 is formed by a material having a relatively high loss tangent (hereinafter, tan δ) of approximately 0.1 or greater. In particular, it is preferable that the material of the inner core layer 12 have a tan δ of approximately 0.2 or greater, and more preferably approximately 0.3 or greater. Although there is no particular restriction with regard to the upper limit of the tan δ of the inner core layer 12, it is preferable that it be approximately 0.5 or less, because the overall initial velocity of the ball will drop.

The outer core layer 14 is formed by a material having a relatively low tan δ of approximately 0.1 or lower. In particular, it is preferable that the tan δ of the material of the outer core layer 14 be approximately 0.05 or lower and more preferably approximately 0.03 or lower. The lower limit on the tan δ of the material of the outer core layer 14 is made approximately 0.001 or greater, and more preferably the lower limit on the tan δ is approximately 0.01 or greater. By making the tan δ of the material of the outer core layer 14 in this range, it is possible to reduce the energy loss.

The difference between the tan δ of the material of the inner core layer 12 and the tan δ of the material of the outer core layer 14 is made approximately 0.05 or greater. By providing this difference in tan δ, in the case in which a golfer strikes this golf ball 1 at a high head speed, because the golf ball 1 deforms greatly, the outer core layer 14 and the inner core layer 12 disposed therewithin and having a higher tan δ act to suppress the overall repulsion performance of the golf ball 1, thereby enabling restriction of the initial velocity. If, however, a golfer strikes the golf ball 1 with a low head speed, because the golf ball 1 deforms a small amount, and because the inner core layer 12 does not act, and the outer core layer 14 disposed outside thereof and having a lower tan δ mainly acts, the overall repulsion performance of the golf ball 1 is maintained at the high repulsion performance of the outer core layer 14, thereby enabling achievement of a high initial velocity.

In this specification, the term low head speed is a speed within the range of a general golfer, who is not a professional or advanced golfer, referring to, for example, approximately 40 m/s or lower, and in particular to approximately 30 m/s or lower. It is preferable that the difference between the tan δ of the material of the inner core layer 12 and the tan δ of the outer core layer 14 be approximately 0.07 or greater and more preferably approximately 0.10 or greater.

The material of the inner core layer 12 having a tan δ in the above-noted range, although not restricted in this manner to these values, is preferably a composition that includes, for example, 60 or more parts by weight of a low-repulsion rubber and 40 or fewer parts by weight of a high-repulsion rubber. In order to achieve a higher tan δ for the material of the inner core layer 12, it is more preferable that the material of the inner core layer 12 be a composition that includes 75 or more parts by weight of a low-repulsion rubber and 25 or fewer parts by weight of a high-repulsion rubber, and it is even more preferable that it be a composition that includes 90 or more parts by weight of a low-repulsion rubber and 10 or fewer parts by weight of a high-repulsion rubber.

Although there is no restriction in this respect, the material of the outer core layer 14 having a tan δ in the above-noted range preferably is a composition that includes 60 or more parts by weight of a high-repulsion rubber and 40 or fewer parts by weight of a low-repulsion rubber. In order to make the tan δ of the material of the outer core layer 14 lower, it is preferable that the material of the outer core layer 14 be a composition that includes 75 or more parts by weight of a high-repulsion rubber and 25 or fewer parts by weight of a low-repulsion rubber, and it is even more preferable that it be a composition that includes 90 or more parts by weight of a high-repulsion rubber and 10 or fewer parts by weight of a low-repulsion rubber.

It is possible to use as the high-repulsion rubber, for example, a polybutadiene such as 1,2-polybutadiene or cis-1,4-polybutadiene or the like, a silicone rubber, or a mixture thereof as the high-repulsion rubber, although there is no restriction in this respect It is possible to use as the low-repulsion rubber, for example, butyl rubber, polyisoprene (IR), styrene butadiene rubber (SBR), natural rubber, fluorine rubber, chloroprene rubber, nitryl rubber, ethylene propylene rubber, acrylic rubber, or urethane rubber or the like or a mixture thereof, although there is no restriction in this respect. It is possible to use modified polybutadiene as noted in Japanese Patent Application Publication 2007-222196 and Japanese Patent Application Publication 2008-161134, which are incorporated herein by reference, as cis-1,4-polybutadiene.

In addition to the above-described high-repulsion rubber and low-repulsion rubber, it is possible to use as a material in forming the inner core layer 12 and the outer core layer 14 a unsaturated fatty acid such as zinc methacrylate or zinc acrylate, or a magnesium salt as a bridging agent, or mix an ester compound such as trimethyl propane methacrylate or the like. It is preferable that, with respect to 100 parts by weight of the above-noted high-repulsion rubber or low-repulsion rubber base rubber 100, approximately 10 parts by weight to approximately 40 parts by weight of bridging agent be added.

It is possible to mix a vulcanizing agent into the material that forms the inner core layer 12 and the outer core layer 14. It is preferable that the vulcanizing agent include peroxide having a one-minute half-life temperature of 155° C. or lower. It is preferable that the peroxide be added in an amount from approximately 0.6 parts by weight to approximately 3 parts by weight with respect to 100 parts by weight of the base rubber 100. Additionally, if necessary, an anti-aging agent, a filler of zinc oxide or barium sulfate for the purpose of adjusting the specific gravity, and pentachlorothiophenol for the purpose of adjusting the initial velocity can be added to the material that forms the inner core layer 12 and the outer core layer 14.

The inner core layer 12 has substantially a spherical shape. Because if the outer diameter of the inner core layer 12 is too large, even if the golf ball 1 is struck at a low head speed, the inner core layer 12 will act and the repulsion performance of the overall golf ball 1 will be insufficient, the outer diameter is made approximately 25 mm or smaller. It is preferable that the outer diameter of the inner core layer 12 be approximately 20 mm or smaller and more preferably approximately 15 mm or smaller. On the other hand, because if the outer diameter of the inner core layer 12 is too small, the effect of limiting the initial velocity of the golf ball is reduced, and it is preferable that the outer diameter be approximately 3 mm or larger and more preferably approximately 5 mm or larger.

The outer core layer 14 covers the inner core layer 12 and has a spherical outer peripheral surface that has the same center as the outer peripheral spherical surface of the inner core layer 12. It is preferable that the outer diameter of the outer peripheral spherical surface of the outer core layer 14 be approximately 20 mm or larger, more preferably approximately 30 mm or larger, and even more preferably approximately 35 mm or larger. It is preferable that the outer diameter of the outer peripheral spherical surface of the outer core layer 14 be approximately 42 mm or smaller, more preferably approximately 41 mm or smaller, and even more preferably approximately 40 mm or smaller.

The size of the energy loss of a golf ball is proportional to the tan δ of the material used in the golf ball and the volume. Because the energy loss of the golf ball must be held to within some limits, the size of the energy loss of a golf ball the tan δ of the material used in the solid core of a golf ball is preferably made in the range of from approximately 0.01 to approximately 0.10. In the present invention, therefore, because the solid core of the present invention has a two-layer structure of the inner core layer 12 and the outer core layer 14, it is preferable that it be designed so as to satisfy the following equation.

$$V_a \times \tan\delta_a + V_b \times \tan\delta_b = C^*(V_a + V_b) \quad \text{(Equation 1)}$$

$V_a$: Volume of the inner core layer 12
$V_b$: Volume of the outer core layer 14
$\tan\delta_a$: tan δ of the material forming the inner core layer 12
$\tan\delta_b$: tan δ of the material forming the outer core layer 14
C: Coefficient The coefficient C in the above equation, as described above, is preferably made a value in the range from approximately 0.01 to approximately 0.10, and more preferably in the range from approximately 0.01 to approximately 0.05.

The hardness of the inner core layer 12, although not restricted, is preferably approximately 30 or greater and approximately 70 or less on the JIS-C scale. The hardness of the outer core layer 14, although not restricted, is preferably approximately 50 or greater and approximately 90 or less on the JIS-C scale. In particular, in order to prevent stress concentrations in the layer boundary between the inner core layer 12 and the outer core layer 14 and the occurrence of energy loss, it is preferable that the hardness at the layer boundary between the inner core layer 12 and the outer core layer 14 be within approximately 10 on the JIS-C scale, more preferably within approximately 6, and even more preferably within approximately 3.

The method of forming the inner core layer 12 and the outer core layer 14 can be a known molding method for a solid core having a multilayer construction. For example, although there is no restriction in this respect, the inner core layer 12 can be obtained by kneading the material using a mixing machine, followed by pressurized vulcanizing of the kneaded mixture in a round mold. Also, although there is no restriction in this respect, the outer core layer 14 can be obtained by kneading the material using a mixing machine, followed by forming the material into a sheet and pressurized vulcanizing of inner core layer 12 covered by this sheet.

The intermediate layer 20, although shown as a single layer in FIG. 1, is not restricted thereto, and can be made to have multiple layers of two or more layers. It is preferable that the material of the intermediate layer 20, although it is not restricted, use a thermal mixture indicated below as the main material. By using these materials in the intermediate layer, it is possible to achieve low spin at the timing of striking, and achieve a long carry distance.

(a) an olefin-unsaturated carboxylic acid random copolymer and/or a metal ion neutralization product of an olefin-unsaturated carboxylic acid two-element random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and, (e) a non-ionomeric thermoplastic elastomer in a weight ratio between 100:0 and 50:50 and with respect to 100 parts by weight of a resin including the base resin and the (e) component, (c) 5 to 80 parts by weight of a fatty acid and/or fatty acid derivative having a molecular weight of 228 to 1500; and (d) 0.1 to 17 parts by weight of a basic inorganic metal compound capable of neutralizing un-neutralized acid groups in the base resin and component (c).

The term "main material" used herein means a material that is at least approximately 50 parts by weight, preferably at least 60 parts by weight, and more preferably at least 70 parts by weight with respect to the total weight of the intermediate layer 20.

The olefin in the base resin, in the case of component (a) or component (b), usually preferably has a carbon atom count of 2 or more and 8 or fewer as the upper limit, and particularly preferably 6 or fewer. Specifically, it is preferable that this be ethylene, propylene, butane, pentene, hexane, heptene, or octane or the like, and ethylene is particularly preferable.

As the unsaturated carboxylic acid, for example, acrylate, methacrylate, maleic acid, or fumaric acid or the like is preferable, and acrylate or methacrylate are particularly preferable.

As an unsaturated carboxylic acid ester, a low alkyl ester of the above-described unsaturated carboxylic acid is preferable. Specifically, this can be methyl methacrylate, ethyl methacrylate, propyl methacrylate, butyl methacrylate, methyl acrylate, ethyl acrylate, propyl acrylate, or butyl acrylate or the like. Butyl acrylate (n-butyl acrylate, i-butyl acrylate) is particularly preferable.

The component (a) an olefin-unsaturated carboxylic acid random copolymer and component (b) olefin-unsaturated carboxylic acid ester random terpolymer (the copolymer of the component (a) and the component (b) being hereinafter referred to collectively as the "random copolymer") can each be obtained by adjusting the above-described materials and using a known method to cause random copolymerization.

It is recommended that the random copolymer have an adjusted amount of unsaturated carboxylic acid (amount of included acid). The amount of unsaturated carboxylic acid included in the random copolymer of the component (a) is usually approximately 4% or greater by weight, preferably approximately 6% or greater by weight, and more preferably approximately 8% or greater by weight. The upper limit is approximately 30% by weight or less, preferably approximately 20% by weight or less, more preferably approximately 18% by weight or less, and even more preferably approximately 15% by weight or less.

In the same manner, the amount of unsaturated carboxylic acid included in the random copolymer of the component (b) is usually approximately 4% or greater by weight, preferably approximately 6% or greater by weight, and more preferably approximately 8% or greater by weight. The upper limit is approximately 15% by weight or less, preferably approximately 12% by weight or less, and more preferably approximately 10% by weight or less. If the amount of acid in the random copolymer is insufficient, there are cases in which the repulsion is reduced, and if it is excessive, there are cases in which the processability is adversely affected.

The component (a) olefin-unsaturated carboxylic acid random copolymer metal ion neutralization product and the component (b) olefin-unsaturated carboxylic acid ester random terpolymer metal ion neutralization product (the copolymer metal ion neutralization products of the component (a) and the component (b) being hereinafter referred to collectively as the "random copolymer metal ion neutralization products") can each be obtained by partially neutralizing the acid group of the above-noted random copolymer using a metal ion.

The metal ion used to neutralize the acid group includes the ions of, for example, Na, K, Li, Zn, Cu, Mg, Ca, Co, Ni, and Pb or the like, and it is preferable to use an ion of Na, Li, Zn, Mg, or the like, and particularly preferable to use an ion of Na from the standpoint of improving the reactivity.

In order to obtain a random copolymer metal ion neutralization product, neutralization can be done of the random copolymer using a metal ion, and this can be done, for example, by the method of performing neutralization using formic acid, an acetate, a nitrate, a carbonate, hydrogen carbonate, an oxide, a hydroxide, or an alkoxide compound or the like. There is no particular restriction with regard to the degree of neutralization of these metal ions with respect to the random copolymer.

It is possible to suitably use sodium ion-neutralized ionomer resins as the above metal ion neutralization products of the random copolymers to increase the melt flow rate of the material, thereby facilitating the adjustment to the optimal melt flow rate to be described below, enabling improvement of the moldability.

Commercially available products may be used as the base resins of above components (a) and (b). Examples of the random copolymer in component (a) include Nucrel 1560, Nucrel 1214 and Nucrel 1035 (all products of DuPont-Mitsui Polychemicals Co., Ltd.), and Escor 5200, Escor 5100, and Escor 5000 (all products of ExxonMobil Chemical) and the like. Examples of the random copolymer in component (b) include Nucrel AN4311 and Nucrel AN4318 (both products of DuPont-Mitsui Polychemicals Co., Ltd.), and Escor ATX325, Escor ATX320, and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). Sodium-neutralized ionomer resins that are suitable as the metal ion neutralization product of the above-noted random copolymer include Himilan 1605, Himilan 1601 and Himilan 1555.

When preparing the above-described base resin, component (a) and component (b) are mixed in a weight ratio of between 100:0 and 0:100, preferably between 100:0 and 25:75, more preferably between 100:0 and 50:50, even more preferably between 100:0 and 75:25, and most preferably 100:0. If insufficient component (a) is included, the molded material obtained therefrom may have a decreased repulsion.

In addition, the moldability of the base resin can be further improved by also adjusting the ratio in which the random copolymers and the metal ion neutralization products of the random copolymers are mixed. It is recommended that the weight ratio of the random copolymers to the metal ion neutralization products of the random copolymers be between 0:100 and 60:40, preferably between 0:100 and 40:60, more preferably between 0:100 and 20:80, and even more preferably 0:100. The addition of excessive random copolymer may lower the moldability during mixing.

Component (e) described below may be added to this kind of base resin. Component (e) is a non-ionomeric thermoplastic elastomer. The purpose of this component is to further improve the feel of the ball on impact and the repulsion. Examples include olefin elastomers, styrene elastomers, polyester elastomers, urethane elastomers, and polyamide elastomers. From the standpoint of further increasing the repulsion, a polyester elastomer or an olefin elastomer, and particularly an olefin elastomer composed of a thermoplastic block copolymer which includes crystalline polyethylene blocks as the hard segments can be used.

A commercially available product may be used as component (e). Examples include Dynaron (made by JSR Corporation) and the polyester elastomer Hytrel (made by DuPont-Toray Co., Ltd.).

It is preferable that component (e) be included in an amount, per 100 parts by weight of the base resin of the invention, of at least approximately 0 parts by weight, more preferably at least approximately 5 parts by weight, even more preferably at least approximately 10 parts by weight, and most preferably at least approximately 20 parts by weight, but preferably not more than approximately 100 parts by weight, more preferably not more than approximately 60 parts by weight, even more preferably not more than approximately 50 parts by weight, and most preferably not more than approximately 40 parts by weight. Excessive component (e) will lower the compatibility of the mixture, possibly resulting in a substantial decline in the durability of the golf ball.

Next, component (c) described below may be added to the base resin. Component (c) is a fatty acid or fatty acid derivative having a molecular weight of at least 228 but not more than 1500. Compared with the base resin, this component has a very low molecular weight, and suitably adjusting the melt viscosity of the mixture contributes in particular to improving the flow properties. Component (c) includes a relatively high content of acid groups (or derivatives thereof), and is capable of suppressing an excessive loss of repulsion.

The fatty acid or fatty acid derivative of component (c) has a molecular weight of at least 228, preferably at least 256, more preferably at least 280, and even more preferably at least 300, but not more than 1500, preferably not more than 1000, even more preferably not more than 600, and most preferably not more than 500. If the molecular weight is too low, the heat resistance cannot be improved. On the other hand, if the molecular weight is too high, the flow properties cannot be improved.

The fatty acid or fatty acid derivative of component (c) may be, for example, an unsaturated fatty acid (or derivative thereof) containing a double bond or triple bond on the alkyl group, or it may be a saturated fatty acid (or derivative thereof) in which the bonds on the alkyl group are all single bonds. In either case, it is preferable that the number of carbon atoms on the molecule be at least 18, more preferably at least 20, even more preferably at least 40, and particularly preferably at least 81, but preferably not more than 200, more preferably not more than 150, and even more preferably not more than 120. Too few carbon atoms may make it impossible to achieve improvement in the heat resistance and may also make the acid group content so high as to reduce the flow-improving effect due to interactions with acid groups present in the base resin. On the other hand, if there are too many carbon atoms, this increases the molecular weight, which may keep a prominent flow-improving effect from appearing.

Specific examples of the fatty acid of component (c) include myristic acid, palmitic acid, stearic acid, 12-hydroxystearic acid, behenic acid, oleic acid, linoleic acid, linolenic acid, arachidic acid, and lignoceric acid and the like. Of these, stearic acid, arachidic acid, behenic acid, and lignoceric acid are preferred, and behenic acid is particularly preferable.

The fatty acid derivative of component (c) is exemplified by metallic soaps in which the proton on the acid group of the fatty acid has been replaced with a metal ion. Examples of the metal ion include Na, Li, Ca, Mg, Zn, Mn, Al, Ni, Fe, Cu, Sn, Pb, and Co ions and the like. The Fe ion may be bivalent or trivalent. Of these, the ions of Ca, Mg, and Zn are particularly preferable.

Specific examples of fatty acid derivatives usable as the component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate, and zinc lignocerate and the like. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate, and zinc lignocerate and the like are particularly preferable.

Component (d) may be added as a basic inorganic metal compound capable of neutralizing acid groups in the base resin and in component (c). If component (d) is not included, when a metal soap-modified ionomer resin is used alone, the metallic soap and un-neutralized acid groups present on the ionomer resin undergo exchange reactions during mixture under heating, generating a large amount of fatty acid. Because the generated fatty acid has a poor thermal stability and readily vaporizes during molding, it may cause molding defects. Additionally, if the fatty acid thus generated is deposited onto the surface of the molded material, it may substantially lower paint film adhesion and may have other undesirable effects such as lowering the repulsion of the resulting molded material.

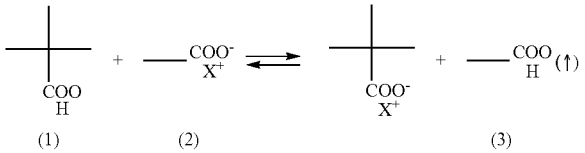

(1) Un-neutralized acid groups in the ionomer resin
(2) Metallic soap
(3) Fatty acid
X: Metal anion To solve this problem, a basic inorganic metal compound (d) which neutralizes the acid groups present in the base resin and component (c), is included as an essential component, thereby improving the repulsion of the molded material.

That is, by including the component (d) as an essential component in the material, not only are the acid groups in the base resin and the component (c) neutralized, through synergistic effects from the optimal addition of each of these components, it is also possible to increase the thermal stability of the mixture and to impart to it good moldability, and also to enhance the repulsion.

In this case, it is recommended that the basic inorganic metal compound used as the component (d) be a compound that has a high reactivity with the base resin and contains no organic acids in the reaction by-products, thus enabling the degree of neutralization of the mixture to be increased without a loss of thermal stability.

Examples of the metal ions in the basic inorganic metal compound of the component (d) include Li, Na, K, Ca, Mg, Zn, Al, Ni, Fe, Cu, Mn, Sn, Pb, and Co ions and the like. The Fe ion may be bivalent or trivalent. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide, and lithium carbonate. In particular, a hydroxide or a monoxide is recommended, calcium hydroxide and magnesium oxide, which have a high reactivity with the base resin, are more preferable, and calcium hydroxide is particularly preferable.

By blending specific respective amounts of components (c) and (d) with the resin component containing specific amounts of components (a) and (b) in combination with the optional component (e), the material has excellent thermal stability, flow properties, and moldability, and can impart to the molded product significantly improved repulsion.

The components (c) and (d) are included in respective amounts, per 100 parts by weight of the resin component suitably formulated from the components (a), (b) and (e), for the component (c) this being at least approximately 5 parts by weight, preferably at least approximately 10 parts by weight, more preferably at least approximately 15 parts by weight, and even more preferably at least approximately 18 parts by weight, but not more than approximately 150 parts by weight, preferably not more than approximately 130 parts by weight, and more preferably not more than approximately 120 parts by weight, and for the component (d) this being at least approximately 0.1 part by weight, preferably at least approximately 0.5 part by weight, more preferably at least approximately 1 part by weight, and even more preferably at least approximately 2 parts by weight, but not more than approximately 17 parts by weight, preferably not more than approximately 15 parts by weight, more preferably not more than approximately 13 parts by weight, and even more preferably not more than approximately 10 parts by weight, of component (d). Insufficient component (c) lowers the melt viscosity, resulting in inferior processability, whereas excessive component (c) lowers the durability. Insufficient component (d) fails to improve thermal stability and repulsion, whereas excessive component (d) instead lowers the heat resistance of the golf ball material due to the presence of excess basic inorganic metal compound.

In the above-described resin material formulated from the respective above-indicated amounts of the resin component and the components (c) and (d), it is recommended that at least approximately 50 mol %, preferably at least approximately 60 mol %, more preferably at least approximately 70 mol %, and even more preferably at least approximately 80 mol %, of the acid groups be neutralized. Such a high degree of neutralization makes it possible to more reliably suppress the exchange reactions that cause a problem when only a base resin and a fatty acid or a fatty acid derivative are used as in the past, thus preventing the generation of fatty acid, and obtaining a resin material of substantially improved thermal stability and good moldability, which can provide molded products of much better repulsion than conventional ionomer resins.

The term "degree of neutralization" as used herein, refers to the degree of neutralization of acid groups present within the mixture of the base resin and the fatty acid or fatty acid derivative serving of the component (c), and differs from the degree of neutralization of the ionomer resin itself when an ionomer resin is used as the metal ion neutralization product of a random copolymer in the base resin. Because a mixture according to the invention having a certain degree of neutralization, when compared with an ionomer resin alone having the same degree of neutralization, contains a very large number of metal ions, there is an increase in the density of ionic crosslinks which contribute to improved repulsion, making it possible to impart to the molded product excellent repulsion.

To more reliably achieve both a high degree of neutralization and good flow properties, the acid groups in the above-described mixture can be neutralized with transition metal ions and with alkali metal and/or alkaline earth metal ions. Although neutralization with transition metal ions results in a weaker ionic cohesion than neutralization with alkali metal and alkaline (earth) metal ions, by using these different types of ions together to neutralize acid groups in the mixture, a substantial improvement can be made in the flow properties.

It is recommended that the molar ratio between the transition metal ions and the alkali metal and/or alkaline earth metal ions be in a range of usually 10:90 to 90:10, preferably 20:80 to 80:20, more preferably 30:70 to 70:30, and even more preferably 40:60 to 60:40. Too low a molar ratio of transition metal ions could fail to provide a sufficient flow-improving effect. On the other hand, a transition metal ion molar ratio which is too high may lower the repulsion.

Examples of the metal ions include, but are not particularly limited to, zinc ions as the transition metal ions and at least one type of ion selected from among sodium, lithium, and magnesium ions as the alkali metal or alkaline earth metal ions.

A known method may be used to obtain a mixture in which the desired amounts of acid groups have been neutralized with transition metal ions and alkali metal or alkaline earth metal ions. Examples of methods of neutralization with transition metal ions (zinc ions) include a method which uses a zinc soap as the fatty acid derivative, a method which uses a zinc ion neutralization product (for example, a zinc ion-neutralized ionomer resin) when formulating components (a) and (b) as the base resin, and a method which uses a zinc compound such as zinc oxide as the basic inorganic metal compound of component (d).

The resin material should preferably have a melt flow rate adjusted to ensure flow properties that are particularly suitable for injection molding, and thus improve moldability. Specifically, it is recommended that the melt flow rate (MFR), as measured according to JIS-K7210 at a temperature of 190° C. and under a load of 21.18 N (2.16 kgf), be preferably at least approximately 0.5 dg/minute, more preferably at least approximately 0.7 dg/minute, even more preferably at least approximately 0.8 dg/minute, and particularly preferably at least approximately 2 dg/minute, but preferably not more than approximately 20 dg/minute, more preferably not more than approximately 10 dg/minute, even more preferably not more than approximately 5 dg/minute, and particularly not more than approximately 3 dg/minute. Too high or low a melt flow rate may result in a substantial decline in processability.

Examples of the material for the intermediate layer 20 include those having the trade names HPF 1000, HPF 2000, HPF AD1027, HPD AD1035, and HPF AD1040, as well as the experimental material HPF SEP1264-3, all produced by E.I. DuPont de Nemours & Co.

Because the intermediate layer 20 is disposed in a region that overlaps with the outer core layer 14, it is preferable that the material of the intermediate layer 20 have a tan δ that is smaller than that of the outer core layer 14. The thickness of the intermediate layer 20, although not restricted in this regard, is preferably approximately 0.5 mm or greater, and more preferably approximately 1.0 mm or greater. The thickness of the intermediate layer 20 is preferable approximately 3.0 mm or less, and more preferably approximately 2.0 mm or less. The hardness of the intermediate layer 20, while not subject to restrictions, is preferable a Shore D hardness of approximately 40 or higher, and more preferably approximately 50 or higher, and the hardness of the intermediately layer 20 is preferably approximately 70 or lower and more preferably approximately 60 or lower.

Multiple dimples 32 are formed on the surface of the cover 30. The material of the cover 30, although not restricted in this regard, can be an ionomer resin, a polyurethane thermoplastic elastomer, or thermoplastic polyurethane. Of these, from the standpoint of repulsion and adhesion, the use of an ionomer resin is preferred. The thickness of the cover 30, although not restricted in this regard, is preferably approximately 0.3 mm or greater, and more preferably approximately 0.5 mm or greater. In order that the above-described effect of the two-layer core construction of the present invention not be lost, the thickness of the cover 30 is preferably approximately 1.5 mm or less, and more preferably approximately 1.0 mm or less. Although not restricted in this regard, the hardness of the cover 30 is preferably a Shore D hardness of approximately 40 or greater, and more preferably approximately 45 or greater. In order that the effect of the two-layer core construction of the present invention not be lost, it is preferable that the hardness of the cover 30 be approximately 55 or less and more preferably approximately 53 or less.

Examples

Golf balls having the constitutions indicated in Table 1 were fabricated and tested to measure their characteristics. The mixtures in the inner core layers and the outer core layers were as shown in Table 2. In each of the mixtures, the specific gravity was 1.14. Vulcanization was performed for 15 minutes at a temperature of 155° C. The mixture of the intermediate layer was as shown in Table 3, and the mixture of the cover was as shown in Table 4. All of the mixture values shown in Table 2 to Table 4 are indicated in parts by weight. The coefficient C in Table 1 was derived from Equation 1 given above.

The outer diameter, μ hardness, USGA initial velocity, and coefficient of restitution (COR) were measured as characteristics of the golf balls. The μ hardness is the amount of compression deformation (mm) when a final of load of 130 kg is applied to the golf ball after an initial load of 10 kg is applied thereto. The USGA initial velocity is an initial velocity of the golf ball as measured in accordance with the conditions set forth by the United States Golf Association. The coefficient of restitution (COR) is the ratio of the rebound speed of a golf ball shot at a steel plate at each of the velocities of 10 m/s, 20 m/s, 30 m/s, and 40 m/s to the velocity at which the ball was shot.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Inner core layer (a) | Outer diameter (mm) | 10 | 10 | 10 | 10 | 10 | 10 | 10 | 10 | 10 |
| | Mixture | A | B | C | A | A | H | A | A | A |
| | tan δ | 0.32 | 0.28 | 0.26 | 0.32 | 0.32 | 0.05 | 0.32 | 0.32 | 0.32 |
| Outer core layer (b) | Outer diameter (mm) | 40 | 40 | 40 | 40 | 37 | 40 | 38.7 | 40 | 37 |
| | Mixture | F | D | E | F | F | G | F | I | F |
| | tan δ | 0.018 | 0.032 | 0.024 | 0.018 | 0.018 | 0.026 | 0.018 | 0.15 | 0.018 |

TABLE 1-continued

| | | | Example 1 | Example 2 | Example 3 | Example 4 | Example 5 | Example 6 | Example 7 | Example 8 | Example 9 |
|---|---|---|---|---|---|---|---|---|---|---|---|
| $\tan \delta_a - \tan \delta_b$ | | | 0.302 | 0.248 | 0.236 | 0.302 | 0.302 | 0.024 | 0.302 | 0.17 | 0.302 |
| $\tan \delta_a$ * volume $W_a$ + $\tan \delta_b$ * volume $W_b$ | | | 761.3 | 1202.2 | 927.8 | 1136.9 | 635.5 | 883.8 | 704.4 | 5115.6 | 635.5 |
| Volume $W_a$ + volume $W_b$ | | | 33510 | 33510 | 33510 | 33510 | 33510 | 33510 | 33510 | 33510 | 33510 |
| Coefficient C | | | 0.023 | 0.036 | 0.028 | 0.034 | 0.019 | 0.026 | 0.021 | 0.153 | 0.019 |
| Intermediate layer | Thickness (mm) | | — | — | — | — | 1.50 | — | — | — | 1.50 |
| | Hardness (Shore D) | | — | — | — | — | 51 | — | — | — | 51 |
| | Mixture | | — | — | — | — | K | — | — | — | J |
| Outer core layer | Thickness (mm) | | 1.35 | 1.35 | 1.35 | 1.35 | 1.35 | 1.35 | 2.00 | 1.35 | 1.35 |
| | Hardness (Shore D) | | 53 | 53 | 53 | 53 | 53 | 53 | 60 | 53 | 53 |
| | Mixture | | L | L | L | L | L | L | M | L | L |
| Golf ball | Outer diameter (mm) | | 42.7 | 42.7 | 42.7 | 42.7 | 42.7 | 42.7 | 42.7 | 42.7 | 42.7 |
| | μ hardness (mm) | | 2.6 | 2.6 | 2.6 | 2.6 | 2.5 | 2.6 | 2.6 | 2.6 | 2.6 |
| | USGA initial velocity (m/s) | | 77.4 | 77.1 | 77.3 | 77.2 | 77.3 | 77.6 | 77.6 | 76.7 | 76.8 |
| | COR | LS10 | 0.888 | 0.887 | 0.887 | 0.886 | 0.886 | 0.883 | 0.884 | 0.874 | 0.876 |
| | | LS20 | 0.853 | 0.854 | 0.853 | 0.852 | 0.851 | 0.851 | 0.851 | 0.847 | 0.848 |
| | | LS30 | 0.817 | 0.819 | 0.819 | 0.816 | 0.818 | 0.817 | 0.818 | 0.812 | 0.814 |
| | | LS40 | 0.782 | 0.783 | 0.784 | 0.778 | 0.781 | 0.783 | 0.784 | 0.775 | 0.775 |
| | | LS40 − LS10 | 0.106 | 0.104 | 0.103 | 0.108 | 0.105 | 0.100 | 0.100 | 0.099 | 0.101 |

TABLE 2

| | A | B | C | D | E | F | G | H | I |
|---|---|---|---|---|---|---|---|---|---|
| Cis-1,4-polybutadiene | — | 35 | 20 | 65 | 80 | 100 | 100 | 90 | 70 |
| Styrene butadiene rubber | 100 | 65 | 80 | 35 | 20 | — | — | 10 | 30 |
| Zinc acrylate | 27 | 27 | 27 | 36 | 36 | 36 | 31 | 27 | 29 |
| Peroxide A | 0.6 | 0.6 | 0.6 | 0.6 | 0.6 | 0.6 | 0.6 | 0.6 | 0.6 |
| Peroxide B | 0.6 | 0.6 | 0.6 | 0.6 | 0.6 | 0.6 | 0.6 | 0.6 | 0.6 |
| Anti-aging agent | 0.1 | 0.1 | 0.1 | 0.1 | 0.1 | 0.1 | 0.1 | 0.1 | 0.1 |
| Anti-oxidizing agent | 18.8 | 19.3 | 19.1 | 15.0 | 15.2 | 15.5 | 18.1 | 20.3 | 20.0 |
| PTCP zinc salt | — | — | — | 2 | 2 | 2 | 0.5 | — | — |

The peroxide A is dicumyl peroxide (manufactured by NOF Corporation under the product name Percumyl D).

The peroxide B is a mixture of 1,1-di(t-butyl peroxy)cyclohexane and silica (manufactured by NOF Corporation under the product name Perhexa C-40).

The anti-aging agent manufactured by Ouchi Shinko Chemical Industrial, Co., Ltd. under the product name Nocrac NS-6.

PTCP zinc salt is the abbreviation of pentachlorothiophenol zinc salt.

TABLE 3

| | J | K |
|---|---|---|
| S8120 | 75 | — |
| DR6100P | 25 | — |
| HPF1000 | — | 100 |

S8120 is an ionomer resin of a Na ion neutralized ethylene-methacrylate-acrylate ester copolymer made by DuPont.

DR6100 is a hydrogenated polymer (olefin thermoplastic elastomer) manufactured by JSR Corporation.

HPF1000 is a terpolymer made by DuPont made of approximately 75 to 76% by weight of ethylene, approximately 8.5% by weight of acrylate, and approximately 15.5 to 16.5% by weight of n-butyl acrylate, with the acid groups 100% neutralized by magnesium ions.

TABLE 4

| | L | M |
|---|---|---|
| H1601 | — | 50 |
| H1557 | 30 | 50 |
| AM7331 | 50 | — |
| H1855 | 20 | — |
| $TiO_2$ | 4 | 4 |
| Ultramarine blue | 0.04 | 0.04 |

H1601 is an ionomer of a sodium ion neutralized ethylene-methacrylate copolymer made by DuPont-Mitsui Polychemicals Co., Ltd.

H1557 is an ionomer of a zinc ion neutralized ethylene-methacrylate copolymer made by DuPont-Mitsui Polychemicals Co., Ltd.

H7331 is an ionomer of a sodium ion neutralized ethylene-methacrylate-acrylate ester copolymer made by DuPont-Mitsui Polychemicals Co., Ltd.

H7331 is an ionomer of a zinc ion neutralized ethylene-methacrylate-acrylate ester copolymer made by DuPont-Mitsui Polychemicals Co., Ltd.

$TiO_2$ is Tipaque R550 manufactured by Ishihara Sangyo Kaisha, Ltd.

Ultramarine blue is EP-62 manufactured by Holliday Pigments.

As shown in Table 1, in Examples 1 to 5, in which the difference between the tan δ of the inner core layer and the outer core layer was a large value of approximately 0.24 or greater, there was a large difference (COR LS10-LS40) of 0.103 to 0.108 between the coefficient of restitution of a golf ball when the shooting speed was a low value of 10 m/s (corresponding to a head speed of 20 m/s) and the coefficient of restitution of a golf ball when the shooting speed was a high value of 40 m/s (corresponding to a head speed of 50 m/s), showing that a high initial velocity is achieved even at a low head speed. In contrast, in Example 6, in which the difference between the tan δ of the inner core layer and the outer core layer is a low value of approximately 0.02, the difference in the coefficient of restitution between a low head speed and a high head speed (COR LS10-LS40) was a low value of 0.100.

For Example 7, in which the Shore D hardness of the cover was a high value of 60 and the thickness was a large value of 2.00 mm, the effect of providing a difference in the tan δ between the outer core layer and the inner core layer is lost, and the difference between the coefficient of restitution at a low head speed and a high head speed (COR LS10-LS40) was a low value of 0.100. In the case of Example 8, in which the coefficient C was approximately 0.15 and the overall core tan δ is large, because of a large energy loss, there was a reduction in the coefficient of restitution at all head speeds, leading to a loss in initial ball velocity. In the case of Example 9 as well, in which a material having poor repulsion performance was used in the intermediate layer, there was a reduction in the coefficient of restitution at all head speeds, leading to a loss in initial ball velocity.

What is claimed is:

1. A multiple-piece solid core golf ball comprising:

a solid core that comprises an inner core layer and an outer core layer; and a cover disposed on the outside of the solid core, wherein the inner core layer has an outer diameter of at most approximately 25 mm and is formed of a material having a loss tangent (tan δ) of at least 0.2, and wherein the outer core layer is formed of a material having a loss tangent (tan δ) of from 0.01 to 0.1, wherein the difference between the loss tangent (tan δ) of the material forming the inner core layer and the loss tangent (tan δ) of the material forming the outer core layer is at least 0.24.

2. The golf ball according to claim 1, wherein the material forming the inner core layer has a composition comprising at least 60 parts by weight of low-repulsion rubber and at most 40 parts by weight of high-repulsion rubber, and the material forming the outer core layer has a composition comprising at least 60 parts by weight of high-repulsion rubber and at most 40 parts by weight of low-repulsion rubber.

3. The golf ball according to claim 1, wherein a value obtained by adding the value of the volume of the inner core layer multiplied by the loss tangent (tan δ) of the material forming the inner core layer to the value of the volume of the outer core layer multiplied by the loss tangent (tan δ) of the material forming the outer core layer is equal to the value obtained by multiplying the sum of the volume of the inner core layer and the volume of the outer core layer by a value within the range from approximately 0.01 to approximately 0.10.

4. The golf ball according to claim 1, wherein the cover has a thickness of approximately 0.3 mm to approximately 1.5 mm and has a hardness of a Shore D hardness of approximately 40 to approximately 50.

5. The golf ball according to claim 1, further comprising an intermediate layer disposed between the solid core and the cover.

6. The golf ball according to claim 5, wherein the intermediate layer is formed by a material including a highly neutralized ionomer resin.

7. The golf ball according to claim 1, wherein the inner core layer has an outer diameter of approximately 3 mm to approximately 25 mm, and the outer core layer has an outer diameter of approximately 20 mm to approximately 42 mm.

8. The golf ball according to claim 1, wherein the inner core layer has a hardness of approximately 30 to approximately 70 on the JIS-C scale, and the outer core layer has a hardness of approximately 50 to approximately 90 on the JIS-C scale.

9. The golf ball according to claim 5, wherein the intermediate layer has a Shore D hardness of approximately 40 to approximately 70.

* * * * *